United States Patent [19]

Pelsue

[11] 4,029,425

[45] June 14, 1977

[54] MANHOLE EXTENSION

[76] Inventor: Thurman A. Pelsue, 3706 S. Hibiscus Way, Denver, Colo. 80237

[22] Filed: July 10, 1975

[21] Appl. No.: 594,662

[52] U.S. Cl. ..... 404/25; 49/477; 277/34.3

[51] Int. Cl.[2] ..... E02D 29/14

[58] Field of Search ..... 404/25, 26; 49/463, 49/466, 477; 52/19, 20; 277/34.3

[56] References Cited

UNITED STATES PATENTS

| | | | |
|---|---|---|---|
| 794,987 | 7/1905 | Kneuper | 277/34.3 X |
| 2,369,823 | 2/1945 | Freed | 277/34.3 |
| 2,488,796 | 11/1949 | Baier | 404/25 |
| 3,142,234 | 7/1964 | Maloon | 52/19 |
| 3,161,229 | 12/1964 | Sanders | 49/477 X |
| 3,294,000 | 12/1966 | Pelsue | 404/25 |
| 3,444,793 | 5/1969 | Pelsue | 404/25 |

FOREIGN PATENTS OR APPLICATIONS

| | | | |
|---|---|---|---|
| 1,032,839 | 6/1966 | United Kingdom | 404/25 |

*Primary Examiner*—Mervin Stein
*Attorney, Agent, or Firm*—Edwin L. Spangler, Jr.

[57] ABSTRACT

This invention relates to an improved manhole extension or shield of the type constituting the subject matter of my U.S. Pat. No. 3,294,000 which improvement comprises providing at least one, and preferably both of the outwardly-facing channels with a circular fence projecting down into the casting bordering the mouth of the manhole so as to bridge any gap left between the latter and the annular flange from which it depends thus cooperating with said casting to retain the inflatable gasket.

4 Claims, 4 Drawing Figures

MANHOLE EXTENSION

In my U.S. patent aforementioned, I disclose a manhole shield or extension which fits down into the metal casting bordering the mouth of a manhole and seals thereagainst with a water tight seal adapted to keep run-off water out of the underground installation. A recessed outwardly-facing channel is provided in one end and a flush outwardly-facing channel on the other which makes the unit reversible to fit two different diameter castings, specifically 27 inch and 30 inch diameter ones.

Ordinarily, one or the other of these channels cooperates with the adjoining inwardly-facing cylindrical wall of the casting or rim bordering the entrance to the manhole to close the open side of the channel and thus retain the inflatable gasket therein to produce the necessary water tight seal. My patented shield has proven quite satisfactory for the so-called "traffic" castings of both the 27 and 30 inch sizes used in the struts with the heavy duty manhole covers because the annular upwardly-facing shoulder or seat upon which the cover rests is recessed beneath the surfaces a distance equal to or greater than the width of the shield channel to accommodate their extra thickness. Even the 27 inch pedestrian or "sidewalk" casting has its shoulder recessed deeply enough to work quite satisfactorily with my shield. A problem, however, has arisen with respect to the 30 inch sidewalk casting which differs substantially from the traffic or street version thereof in that the lid or cover is considerably thinner and, therefore, the seat is a good deal shallower. The net result of this has been to leave a sizable gap between the upper margins of the shield channel and casting through which the gasket extrudes when it is inflated.

The obvious consequence of such an extrusion is to lose the water tight seal. Occasionally, the gasket will even rupture. There are, however, several unforeseen consequences of a much more serious nature.

The most serious of these is the failure of the shield to lock securely inside the 27 inch sidewalk casting which it does in both the 30 inch castings and the 27 inch strut casting. Since the ladder entering the underground installation is hung from a point well below ground level and the shield projects a good way above it, the workmen must use the shield to enter the manhole either by sitting on its edge or hanging from it while their feet seek the ladder rungs. If, as one might suspect, the shield is not securely fastened inside the casting, it can easily become dislodged under the weight of a workman, especially when applied to only one side thereof. When this occurs, the shield tilts and the workman can be dropped into the open manhole where he is seriously injured. While such accidents are by no means commonplace, they have occurred on certain occasions.

Another unforeseen problem is that the gasket upon inflation acts as a jack to lift the shield out of the casing. Such, of coure, is unacceptable both from the sealing standpoint and the failure of the shield to seat securely in the casting where it can be used as a handrail and the like.

An obvious remedy is, of course, to fabricate a shield with narrower channels specifically designed for use with the shallower 27 inch sidewalk castings. Such a solution is, however, impractical because this means carrying two different sizes of shield on the service trucks when the one designed for use in the small sidewalk casting is only rarely needed. In the field, attempts to solve the problem have usually taken the form of some kind of clamps releasably locking the shield and casting together, often supplemented by ropes crisscrossing the entryway. Only limited success has been realized with this approach and the presence of the extra hardware and ropes have, if anything, contributed to the hazardous conditions.

It has now been found in accordance with the teaching of the instant invention that these and other shortcomings of the prior art attempts to solve the problem have been overcome by the simple, yet unobvious, expedient of merely partially bridging the opening in each outwardly-facing channel by a circular fence hanging down from the uppermost flange of the operative pair thereof. This fence is recesed radially inward relative to the flange from which it depends so as to leave an overhanging support adapted to rest atop the traffic castings at ground level that is most important in terms of promoting stability of the shield against tilting. The fence closes any gap left between the top of the casting and the flange at the top of the operative channel effective to prevent any extrusion of the inflatable gasket. Also, by thus confining the gasket, it apparently is unable to exert sufficient upward pressure against the underside of the shield to dislodge it under normal inflation pressures, probably because of the reduced surface contact therebetween in other than a radial direction. Furthermore, the presence of these fences in both channels in no way inhibits or otherwise impairs their normal use with the 30 inch castings or the 27 inch strut casting.

It is, therefore, the principal object of the present invention to provide a novel and improved manhole shield.

A second objective is the provision of a device of the type aforementioned which is compatible with both the 30 inch and the 27 inch manhole rims or castings of both the "traffic" and "pedestrian" types.

Another object is to provide a manhole shield in which each of the outwardly-facing channels can be retrofitted with a fence effective to retain the gasket without being otherwise modified.

Still another objective is the provision of a device of the character described wherein the addition of the fence in no way interferes with normal use of the shield or its ability to form a water tight seal within the casing.

An additional object is to provide a shield of the type herein disclosed and claimed that locks securely within the casting and not only remains in place while the gasket is inflated but becomes almost impossible to dislodge under normal use.

Further objects are to provide an improved manhole shield which is simple, compact, lightweight, rugged, easy to use, versatile, dependable and compatible with all the most common sizes and designs of manhole casing.

Other objects will be in part apparent and in part pointed out specifically hereinafter in connection with the description of the drawings that follows, and in which.

Figure 2:
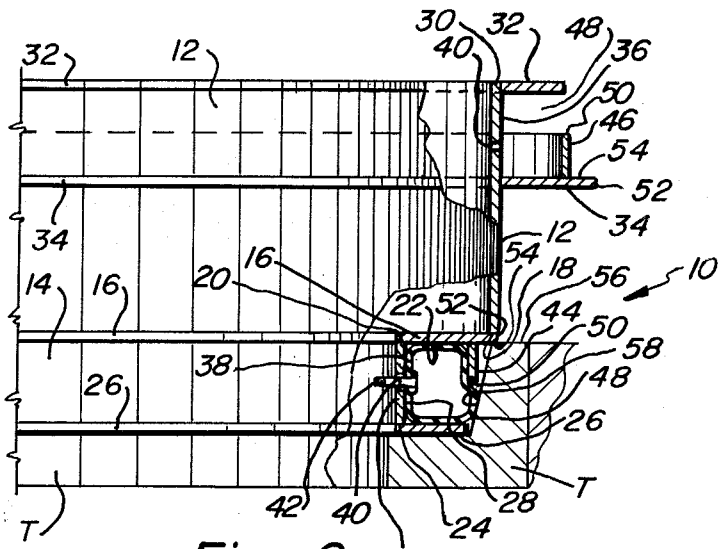
FIG. 2 is a view like FIG. 1 except that the gasket is shown inflated to produce a water tight joint.

Referring next to the drawings for a detailed description of the present invention, reference numeral 10 represents the improved manhole shield of the present invention in a general way and it will be seen to include all of the elements of my previously patented shield among which are the large diameter tubular ring 12 jointed to the small diameter tubular ring 14 in end-to-end concentric relation by an annular flange 16 that bridges the gap left between their adjacent edges 18 and 20, respectively thus producing an overhanging ledge 22 therebetween. The remote edge 24 of the small tubular ring 14 is rimmed by a second annular flange 26 which cooperates therewith and with the first annular flange 16 to define a recessed outwardly facing channel 28.

The remote edge 30 of the large ring is also bordered by a third annular flange 32 similar to the second but of appropriate larger diameter. The fourth annular flange 34 encircles the large ring intermediate the ends thereof in spaced substantially parallel relation to flange 32. This pair of flanges 32 and 34 cooperate with one another and with the ring 12 from which they depend to define a flush outwardly-facing channel 36 paralleling recessed channel 28 on the opposite end of the unit 10. In the particular form shown, flange 34 is somewhat wider than flange 26.

A common inflatable bicycle inner tube 38 is selectively mountable in either of the channels 28 or 36, the tube being stretchable to the extent necessary to accommodate the greater diameter of the latter. Rings 12 and 14 each contain apertures 40 opening within the channels of which they form a part to receive the valve stem 42.

Up to this point, the manhole shield or extension that has been described is, for all practical purposes, identical to that forming the subject matter of my U.S. patent referred to previously. The improved shield of the present invention, on the other hand, is modified to include circular fences 44 and 46 within each of the channels 28 and 36 that encircle the rings forming a part thereof in radially spaced concentric relation. These fences are of a height substantially less than the width of the channel in which they are located so as to leave a gap 48 between their free edges 50 and the other of the pair of annular flanges constituting parts of the same channel. In the particular form shown, both of these fences are spaced inward radially from the circumferential edges 52 of the annular flanges from which they depend so as to leave an overhang 54 projecting therebeyond. More significant, however, is the fact that the fences always depend from the uppermost flange of the pair in use or what will be denominated here as the "operative channel" in contrast to the inoperative one up on top of the shield.

Figure 1:
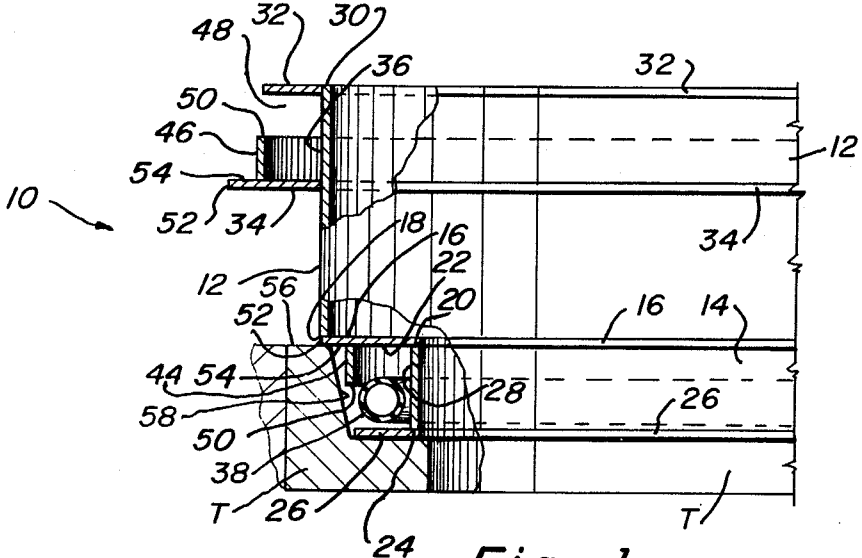
FIG. 1 is an elevation, portions of which have been broken away and shown in diametrical section illustrating the recessed channel of the improved shield in place within a 27 inch traffic casing prior to inflation of the gasket.

In FIG. 1 it will be seen that recessing the fence 44 behind the circumferential margin 52 of flange 54 leaves enough of the latter overhanging to rest atop the rim 56 bordering the traffic flange at strut level. When thus recessed, it also accommodates the upwardly and outwardly flared frustoconical wall 58 of the casing.

Now, when used with the deeper traffic casing T of FIGS. 1 and 2, the upper flange (54) of those forming a part of the operative (recessed) channel (28) still rest upon the rim 56 of the casing as before. When the gasket 38 is inflated as shown in FIG. 2, it merely expands outwardly against the inside of fence 44 rather than resting entirely against the frustoconical casing wall 58 as would have been true of my earlier patented shield. It still, of course, engages a portion of the casing wall, specifically, that which is accessible through gap 48.

Figure 4:
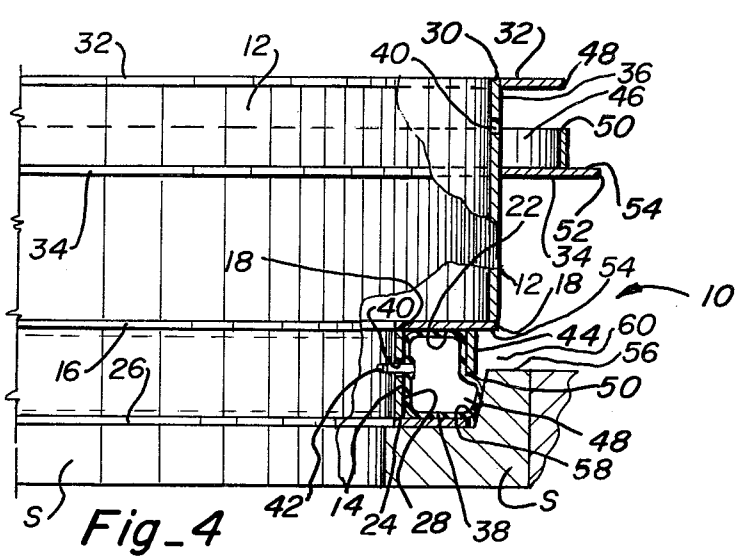
Figure 3:
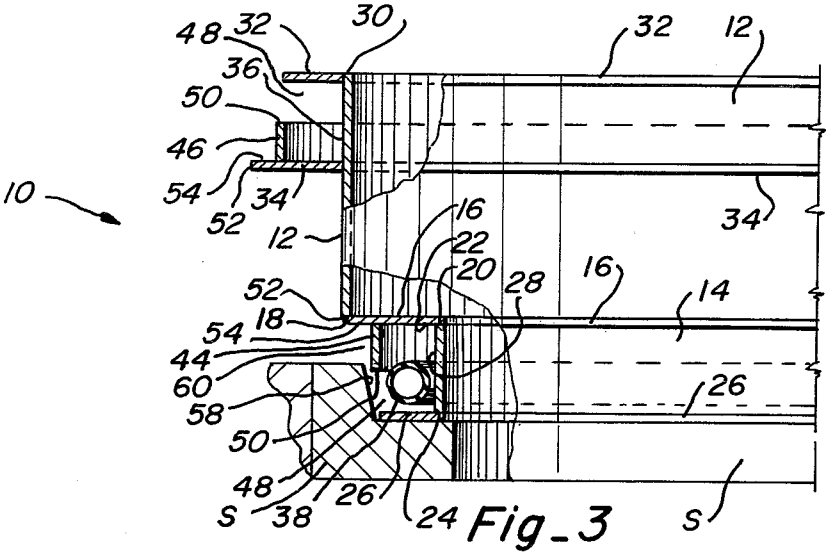
FIG. 3 is a view like FIGS. 1 and 2 but showing the recessed channel in place within the shallower 27 inch sidewalk casing before the gasket has been inflated; and, FIG. 4 is a view like the other three showing the shield within the sidewalk casing following inflation of the gasket.

Next, in FIG. 3, the same recessed channel 28 is shown in use within the relatively shallower 27 inch sidewalk casing S. It will become readily apparent that without fence 44 bridging the gap 60 left between the rim 56 of the casing and the underside of flange 54, gasket 38 would extrude through this gap when inflated. Furthermore, it would function to lift the shield out of the casing where it is much easier to dislodge. The improved version of the shield illustrated in the drawings, on the other hand, has fence 44 bridging gap 60 left between the rim 56 of the strut casing S and the upper flange (14) of the pair in the operative channel (28). Actually, by comparing FIGS. 2 and 4, it will be seen that as far as gasket 38 is concerned, it responds to the frustoconical wall 58 bordering the inside of the casing and fence 44 exactly the same way with respect to the traffic casing T as with the strut casing S.

Finally, turning the extension 10 upside down for use in 30 inch casings merely makes flush channel 36 the operative one instead of recessed channel 28. Fence 46 cooperates to bridge the gap that would exist between the rim of the larger diameter version of the strut casing (not shown) and the underside of flange 35 when turned upside down in exactly the same way as the elements of recessed channel 28 cooperate with the analogous structures of the 27 inch flange illustrated. No useful purpose, therefore, would be served by illustrating and describing the selfsame function with respect to the larger casing and flush channel.

What is claimed is:

1. In a manhole extension for use in manhole casings of the type having an upwardly-facing annular seat recessed beneath a rim bordering the upper marginal edge of an upstanding wall therebetween wherein said extension includes a lower annular flange adopted to rest atop the casing seat, an upper annular flange spaced above the lower one, a ring connecting the inner edges of the upper and lower flanges cooperating therewith to define an outwardly-facing channel, and an inflatable gasket positioned within said channel for the purpose of sealing the joint between said extension and casing, the improvement which comprises a circular fence depending from the upper annular flange defining a gasket receiving seat which extends from the upper flange to a location spaced apart from the lower flange to span a gap between the top of the casing and the upper flange, said inflatable gasket being positioned outside of said gasket receiving seat to expand into said gasket receiving area and against the inside of said fence, said fence being positioned and adapted to cooperate with the channel and with the upstanding casing wall when the upper flange is placed thereagainst to define an enclosure substantially completely enveloping the gasket upon inflation thereof while leaving a portion of the inflated gasket exposed to engage said casing wall as well as the inside of said fence to form a continuous annular fluid-tight seal therewith while preventing extrusion of the inflated gasket out of the gap.

2. The improved manhole extension as set forth in claim 1 in which the diameter of the fence is approximately the same as the outside diameter of the lower flange.

3. The improved manhole extension as set forth in claim 1 in which the height of the fence is approximately half the width of the channel.

4. The improved manhole extension as set forth in claim 1 in which the fence is located intermediate the inner and outer edges of the upper flange.

* * * * *